US009149414B1

(12) United States Patent
Zawahry

(10) Patent No.: US 9,149,414 B1
(45) Date of Patent: Oct. 6, 2015

(54) NURSING ASSISTANCE DEVICE

(71) Applicant: Heather Shaffer Zawahry, Panama City, FL (US)

(72) Inventor: Heather Shaffer Zawahry, Panama City, FL (US)

( * ) Notice: Subject to any disclaimer, the term of this patent is extended or adjusted under 35 U.S.C. 154(b) by 0 days.

(21) Appl. No.: 14/534,670

(22) Filed: Nov. 6, 2014

Related U.S. Application Data

(60) Provisional application No. 61/900,784, filed on Nov. 6, 2013.

(51) Int. Cl.
*A61J 9/00* (2006.01)
*A61J 9/06* (2006.01)

(52) U.S. Cl.
CPC *A61J 9/006* (2013.01); *A61J 9/005* (2013.01); *A61J 9/06* (2013.01); *A61J 2009/0676* (2013.01)

(58) Field of Classification Search
CPC ..... A61J 11/0005; A61J 9/00; A61J 9/06; A61M 25/02; A61M 2025/0266
USPC ..... 224/148.2; 604/174, 180
See application file for complete search history.

(56) References Cited

U.S. PATENT DOCUMENTS 3,757,784 A 9/1973 Avery
4,784,641 A 11/1988 White
5,413,562 A * 5/1995 Swauger ..... 604/179
5,474,193 A 12/1995 Larson
5,810,781 A * 9/1998 Bierman ..... 604/174
5,901,889 A * 5/1999 Ho ..... 224/148.2
6,585,711 B1 7/2003 Lohrasbi
6,827,705 B2 * 12/2004 Bierman ..... 604/180
8,177,756 B2 * 5/2012 Wright ..... 604/174
8,267,921 B2 9/2012 Yodfat
8,292,844 B1 * 10/2012 Diomede ..... 604/82
8,834,425 B2 * 9/2014 Bracken et al. ..... 604/179
8,985,357 B1 * 3/2015 Strayer et al. ..... 215/11.1
9,060,917 B1 * 6/2015 Tronson ..... 1/1
2004/0182813 A1 * 9/2004 Gilmore ..... 215/11.4
2006/0270994 A1 * 11/2006 Bierman ..... 604/180
2009/0166481 A1 * 7/2009 Chen ..... 248/102
2011/0270164 A1 11/2011 Bane
2012/0065608 A1 3/2012 Martin

* cited by examiner

*Primary Examiner* — Justin Larson
(74) *Attorney, Agent, or Firm* — Neustel Law Offices

(57) ABSTRACT

A nursing assistance device for aiding with the delivery of breast milk and/or formula while augmenting breastfeeding. The nursing assistance device generally includes a housing adapted to be secured to the breast to aid in nursing. The housing includes an inner channel in which a syringe dispenser or dispenser tube may be positioned. Each of the dispensers includes an outlet tube through which fluids such as formula and/or breast milk may be dispensed alongside the nipple. The dispenser tube may be connected to various sources of fluid, such as a pouch. The lower surface of the housing includes a securing member which will enable the housing to be removably and comfortably secured to the breast during use. The outlet tube is positioned directly alongside the nipple so that the infant may latch onto both the nipple and the outlet tube to augment breast feeding and facilitate nipple stimulation.

20 Claims, 12 Drawing Sheets

NURSING ASSISTANCE DEVICE

CROSS REFERENCE TO RELATED APPLICATIONS

I hereby claim benefit under Title 35, United States Code, Section 119(*e*) of U.S. provisional patent application Ser. No. 61/900,784 filed Nov. 6, 2013. The 61/900,784 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a nursing aid and more specifically it relates to a nursing assistance device for aiding with the delivery of breast milk and/or formula while augmenting breastfeeding.

2. Description of the Related Art

Any discussion of the related art throughout the specification should in no way be considered as an admission that such related art is widely known or forms part of common general knowledge in the field.

In recent decades, it has become widely accepted that a mother's breast milk is preferable to formula in most infants. However, breastfeeding can be a challenge even with full term pregnancies with uncomplicated deliveries. The challenge of breastfeeding can be multiplied exponentially when there are delivery complications or pre-term infants. Most hospitals these days employ at least one lactation consultant due to the prevalence of problems with nursing.

Pre-term infants often do not have the musculature or well-developed cheek fat pads necessary to properly latch onto a nipple and nurse. Also, mothers after complicated deliveries or with pre-term infants may experience difficulties with their milk supply and thus require at least partial use of formula. These mothers still often have a desire to experience nursing their newborn infant.

Because of the inherent problems with the related art, there is a need for a new and improved nursing assistance device for aiding with the delivery of breast milk and/or formula while augmenting breastfeeding and facilitating nipple stimulation to increase a mother's milk supply.

BRIEF SUMMARY OF THE INVENTION

The invention generally relates to a nursing aid which includes a housing adapted to be secured to the breast to aid in nursing. The housing includes an inner channel in which a syringe dispenser or dispenser tube may be positioned. Each of the dispensers includes an outlet tube through which fluids such as formula and/or breast milk may be dispensed alongside the nipple. The dispenser tube may be connected to various sources of fluid, such as a pouch. The lower surface of the housing includes a securing member such as a silicone adhesive pad, which will allow the lower surface of the housing to be removably and comfortably secured to the breast during use. The outlet tube is positioned directly alongside the nipple so that the infant may latch onto both the nipple and the outlet tube to augment breast feeding and facilitate nipple stimulation to increase a mother's milk supply.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
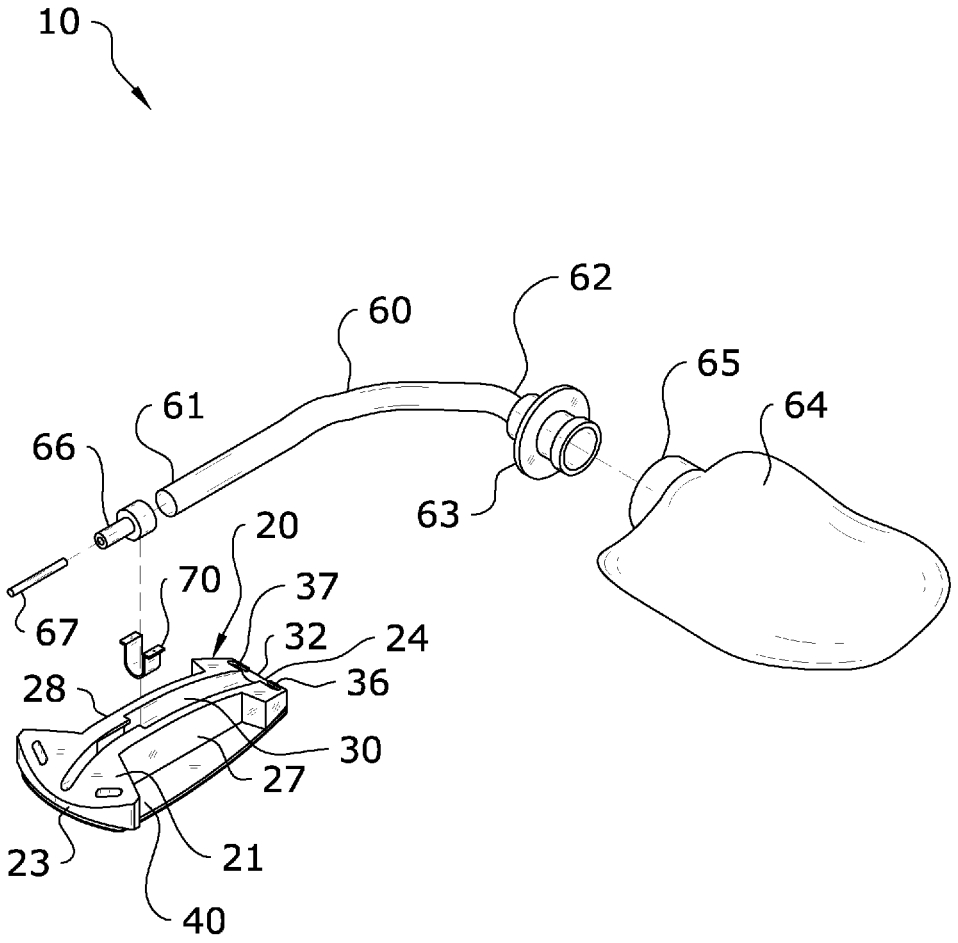
FIG. 1 is an upper perspective exploded view of the tube dispenser embodiment of the present invention.

Turning now descriptively to the drawings, in which similar reference characters denote similar elements throughout the several views, FIGS. 1 through 14 illustrate a nursing assistance device 10, which comprises a housing 20 adapted to be secured to the breast 12 to aid in nursing. The housing 20 includes an inner channel 30 in which a syringe dispenser 50 or dispenser tube 60 may be positioned. Each of the dispensers 50, 60 includes an outlet tube 57, 67 through which fluids such as formula and/or breast milk may be dispensed alongside the nipple 13. The dispenser tube 60 may be connected to various sources of fluid, such as a pouch 64. The lower surface 22 of the housing 20 includes a securing member 40 such as a silicone adhesive pad, which will allow the lower surface 22 of the housing 20 to be removably and comfortably secured to the breast 12 during use. The outlet tube 57, 67 is positioned directly alongside the nipple so that the infant may latch onto both the nipple 13 and the outlet tube 57, 67 to augment breast feeding and facilitate nipple stimulation to increase a mother's milk supply.

B. Housing and Securing Member

As shown throughout the figures, the present invention includes a housing 20 which is adapted to be secured to a woman's breast 12 adjacent to the nipple 13 for dispensing fluids such as breast milk and/or formula while augmenting nursing. The shape and configuration of the housing 20 may vary in different embodiments as will be discussed, and thus the shape and configuration of the housing 20 should not be construed as being limited by the exemplary figures included herewith. It is also appreciated that the housing 20 may be comprised of various materials, including latex, silicone, plastics, and the like, so long as the housing 20 is comfortable when secured against the woman's body and non-toxic to both the woman and the baby.

The housing 20 generally includes an upper surface 21, which faces outwardly from the breast 12, and a lower surface 22, which faces toward the breast 12 when the present invention is in use. As shown in the figures, the upper surface 21 may have a curved configuration while the lower surface 22 may have a flat configuration. It should be appreciated, however, that other configurations may be utilized without affecting the overall operation of the present invention.

As shown throughout the figures, the housing 20 includes a front end 23 which is positioned adjacent to the nipple 13 and a rear end 24 which faces the woman wearing the present invention. To ease grasping the housing 20, the first side 25 of the housing 20 may include a first grip depression 27 and the second side 26 of the housing 20 may include a second grip depression 28. It should be appreciated, however, that some embodiments may omit the grip depressions 27, 28.

An inner channel 30 extends through the housing 20 from the rear end 24 to the front end 23. As shown throughout the figures, the dispenser 50, 60 of the present invention will be positioned within the inner channel 30 when the present invention is in use. The dispenser 50, 60 may be fixedly or removably secured within the housing 20.

Figure 3:
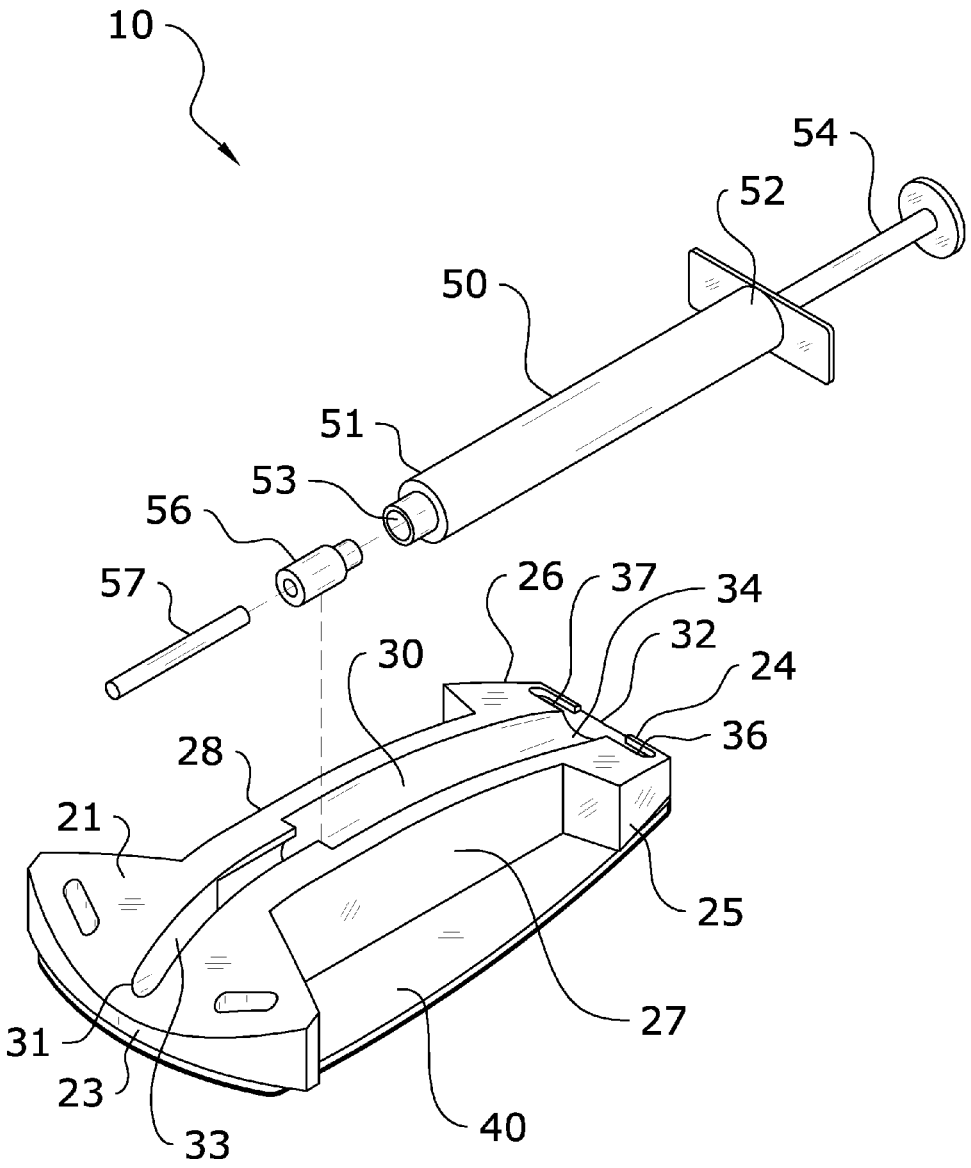
FIG. 3 is an upper perspective exploded view of the syringe dispenser embodiment of the present invention.
Figure 4:
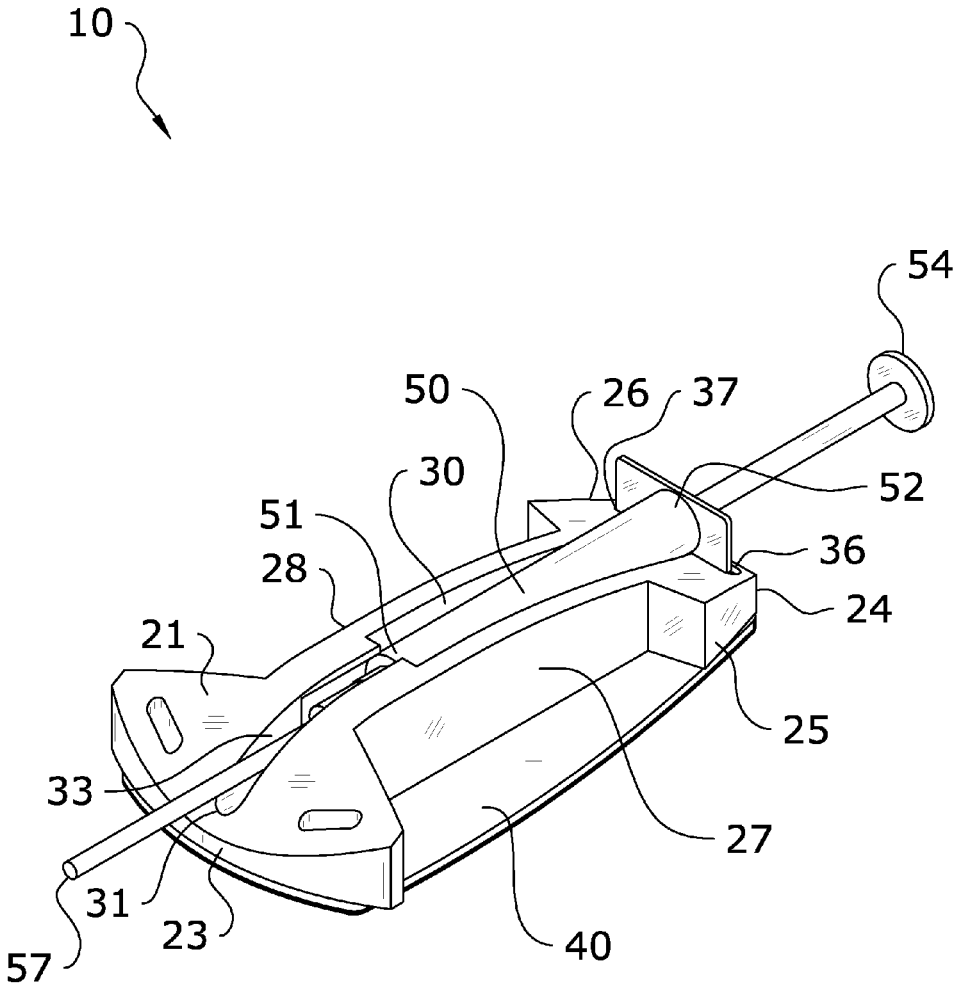
FIG. 4 is an upper perspective view of the syringe dispenser embodiment of the present invention.

As best shown in FIG. 3, the inner channel 30 may include a first portion 33 extending from the front end 31 of the inner channel 30 and a second portion 34 extending from the rear end 32 of the inner channel 30. The first portion 33 will generally comprise a narrower width than that of the second portion 34. The dispenser 50, 60 of the present invention is secured within the second portion 34 of the inner channel 30 while the outlet 57, 67 extends through the first portion 33 of the inner channel 30 and out of the front end 31 of the inner channel 30 as shown in FIG. 4.

The rear end 24 of the housing 20 may optionally include a pair of syringe slots 36, 37 as best shown in FIG. 3. In such an embodiment, a first syringe slot 36 will be positioned at or near the rear end 24 of the housing 20 adjacent to its first side 25. A second syringe slot 37 will be positioned at or near the rear end 24 of the housing 20 adjacent to its second side 26. Any flange or projection from the second end 52 of the syringe dispenser 50 (as is common with syringes) will fit within the syringe slots 36, 37 when the syringe dispenser 50 is secured within the housing 20 for use as shown in FIG. 4.

Figure 8:
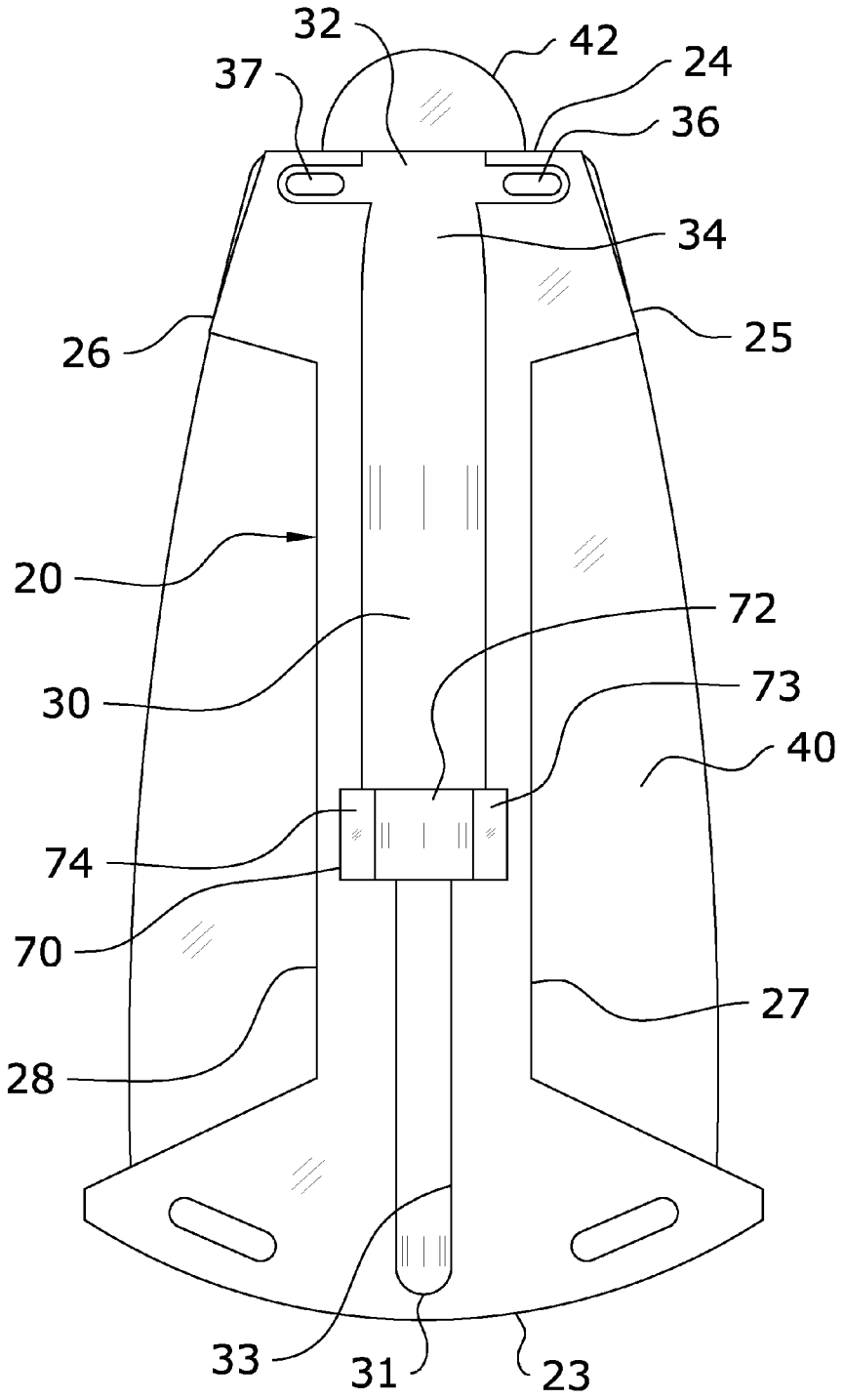
FIG. 8 is a top view of the housing of the present invention.
Figure 9:
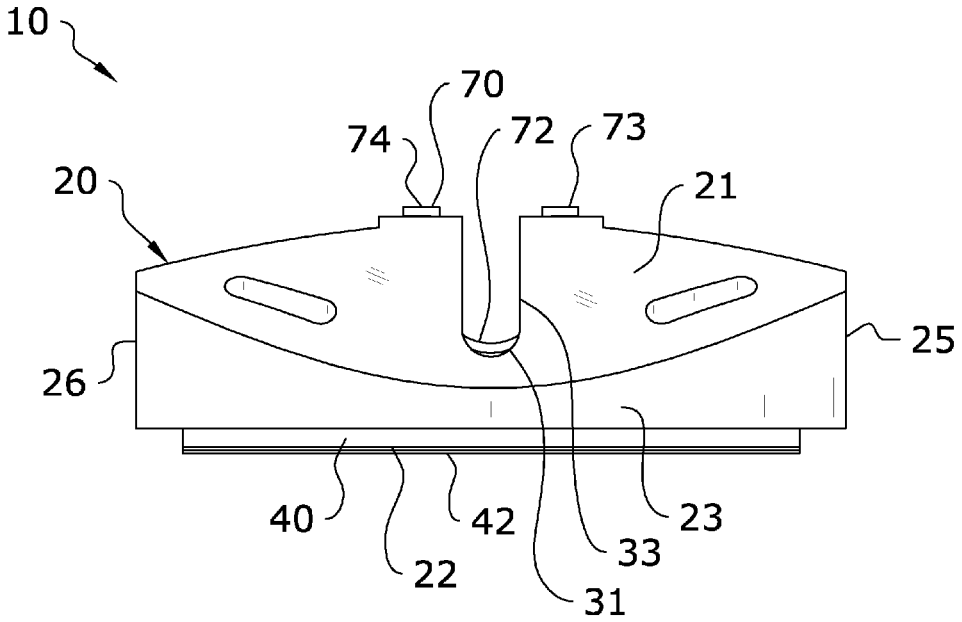
FIG. 9 is a frontal view of the housing of the present invention.
Figure 10:
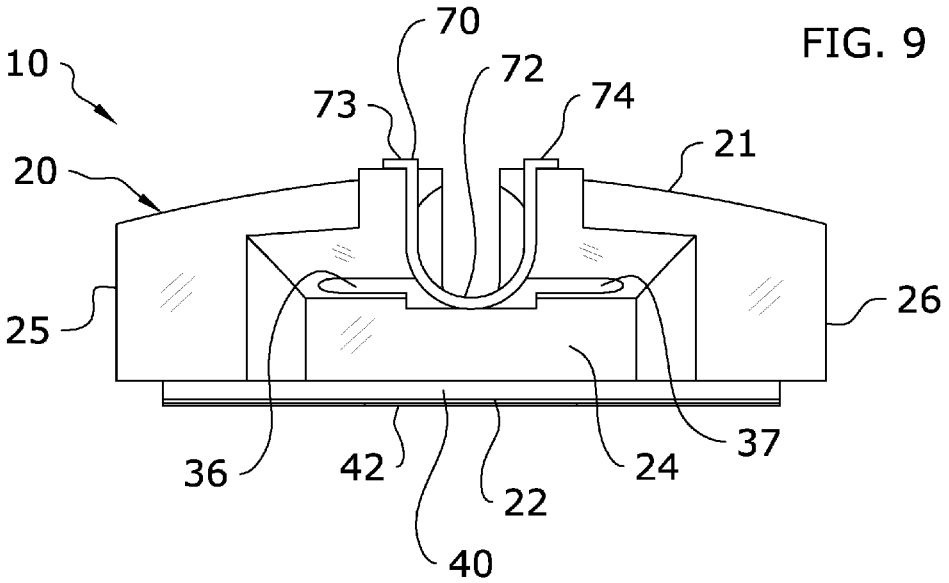
FIG. 10 is a rear view of the housing of the present invention.
Figure 11:
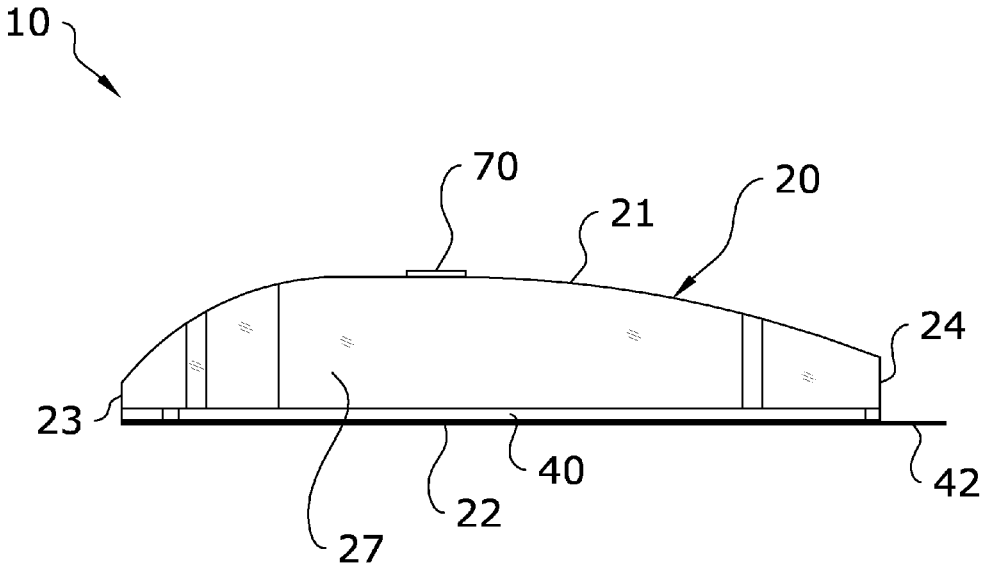
FIG. 11 is a side view of the housing of the present invention.
Figure 12:
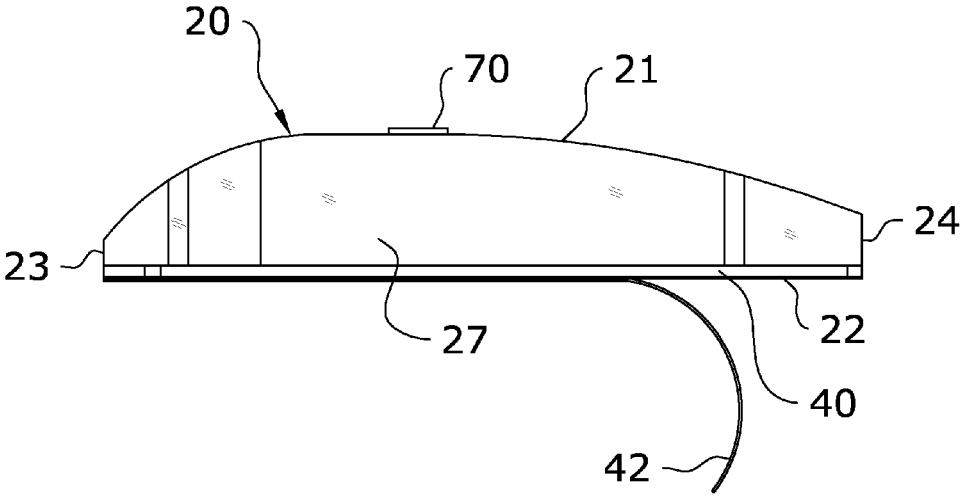
FIG. 12 is a side view of the housing of the present invention illustrating removal of the cover.

As best shown in FIGS. 8 and 11-12, the housing 20 will generally include a securing member 40 on its lower surface 22 to removably and comfortably secure the housing 20 to the breast 12. The securing member 50 may be comprised of various structures, including the use of a securing pad 50 as shown in the figures. The lower surface of the securing member 50 will be adapted to removably secure to the breast 12 and the upper surface of the securing member 30 may be fixedly or removably secured to the inner surface 22 of the housing 20 as shown throughout the figures.

In some embodiments, the housing 20 may be adapted to directly engage with the skin of the breast 12 without a separate securing member 50, such as through use of an adhesive. In some embodiments, a securing member 50 may be omitted entirely. In a preferred embodiment, the securing member 50 will be comprised of a silicon adhesive pad as shown in the figures, though other types of pads and the like may be utilized to secure the housing 20 to the breast 12. For certain adhesive substances, a cover 42 may be positioned over the securing member 50 to retain its adhesiveness prior to use. The cover 42 may thus be removed just prior to securing the housing 20 to the breast 12.

C. Dispensers

Figure 2:
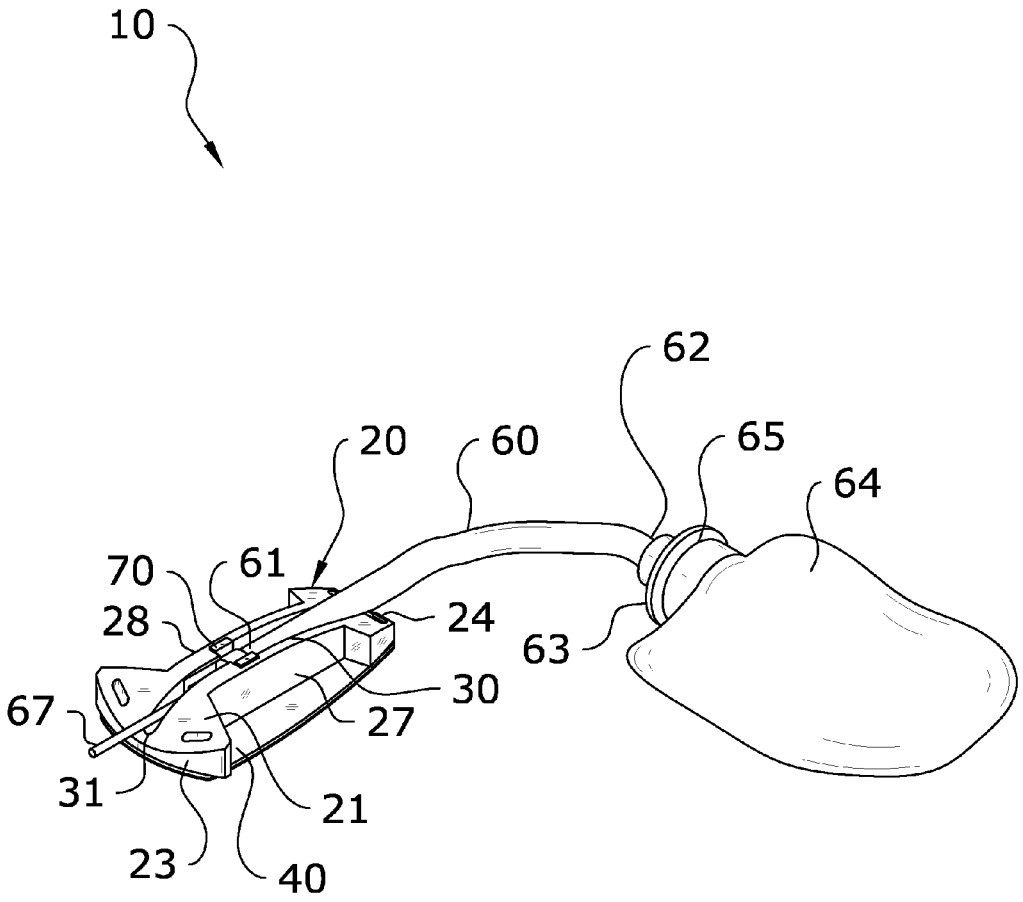
FIG. 2 is an upper perspective view of the tube dispenser embodiment of the present invention.

As shown throughout the figures, a dispenser 50, 60 is positioned within the inner channel 30 of the housing 20 such that an outlet 57, 67 of the dispenser 50, 60 extends out of the front end 23 of the housing 20. The dispenser 50, 60 is utilized to store and/or dispense fluids through the outlet 57, 67 adjacent to the nipple 13 as shown in the figures. It should be appreciated that a wide range of dispensers 50, 60 may be utilized with the present invention. The figures illustrate two exemplary embodiments; a syringe dispenser 50 as shown in FIGS. 3 and 4 and a tube dispenser 60 as shown in FIGS. 1 and 2.

The syringe dispenser 50 generally comprises a conventional syringe configuration as is known in the art. The syringe dispenser 50 thus includes a first end 51 and a second end 52 with a chamber 53 extending therebetween. The chamber 53 of the syringe dispenser 50 acts as a fluid source for the syringe dispenser 50. A plunger 54 is slidably positioned within the chamber 53 via an opening at the second end 52 of the syringe dispenser 50. The plunger 54 is utilized to force any fluids stored within the chamber 53 out of the syringe outlet 55 at the first end 51 of the syringe dispenser 50 as shown in the figures.

The syringe dispenser 50 will generally fit within the second portion 34 of the inner channel 30 as shown in FIG. 4. To extend the reach of the syringe dispenser 50 out of the front end 23 of the housing 20, a coupler 56 may be provided that secures to the syringe outlet 55 as shown in FIG. 3.

The coupler 56 connects the syringe outlet 55 with a tube outlet 57 which extends through the first portion 33 of the inner channel 30 and out the front end 23 of the housing 20. The tube outlet 57 will generally comprise an elongated tube which is fluidly interconnected with the syringe outlet 55. Any type of couplers 56 may be utilized. In some embodiments, a coupler 56 may be omitted, with the tube outlet 57 being integral with the syringe dispenser 50.

The tube dispenser 60, best shown in FIGS. 1 and 2, comprises an elongated tube having a first end 61 and a second end 62. The second end 62 of the tube dispenser 60 is fluidly connected with a fluid source such as a pouch 64 as shown in the figures. The tube dispenser 60 may be directly connected to the pouch outlet 65 of the pouch 64 (or even integrally formed therewith) or, as shown in the exemplary figures, may be connected to the pouch outlet 65 via a pouch coupler 63. In such embodiments, any type of pouch coupler 63 may be utilized to fluidly connect the pouch 64 to the tube dispenser 60.

In some embodiments, the tube dispenser 60 may extend through the entire inner channel 30 and out of the front end 23 of the housing 20. In the exemplary embodiments shown in the figures, a separate tube outlet 67 comprised of a narrow, elongated tube may be secured to the first end 61 of the tube dispenser 60, such as via a coupler 66.

In other embodiments, the tube dispenser 60 may be an integral tube having varying diameters, with a wider diameter for the portion inserted within the second portion 34 of the inner channel 30 and a narrower diameter for the portion inserted within the first portion 33. In any embodiment, the tube outlet 67 extends out of the front end 23 of the housing 20 to be positioned near the nipple 13 for use.

Figure 5:
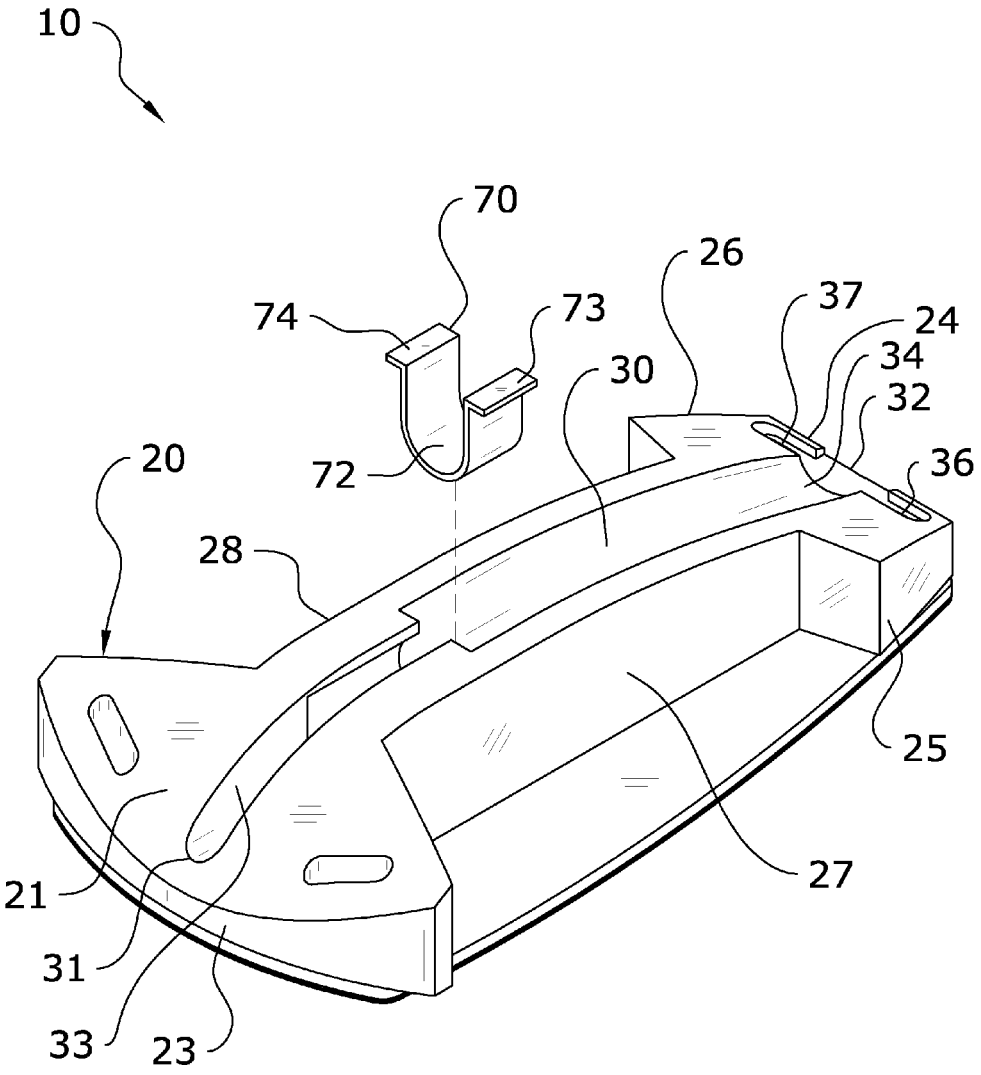
FIG. 5 is an upper perspective view of the housing of the present invention with adapter aligned for insertion.
Figure 6:
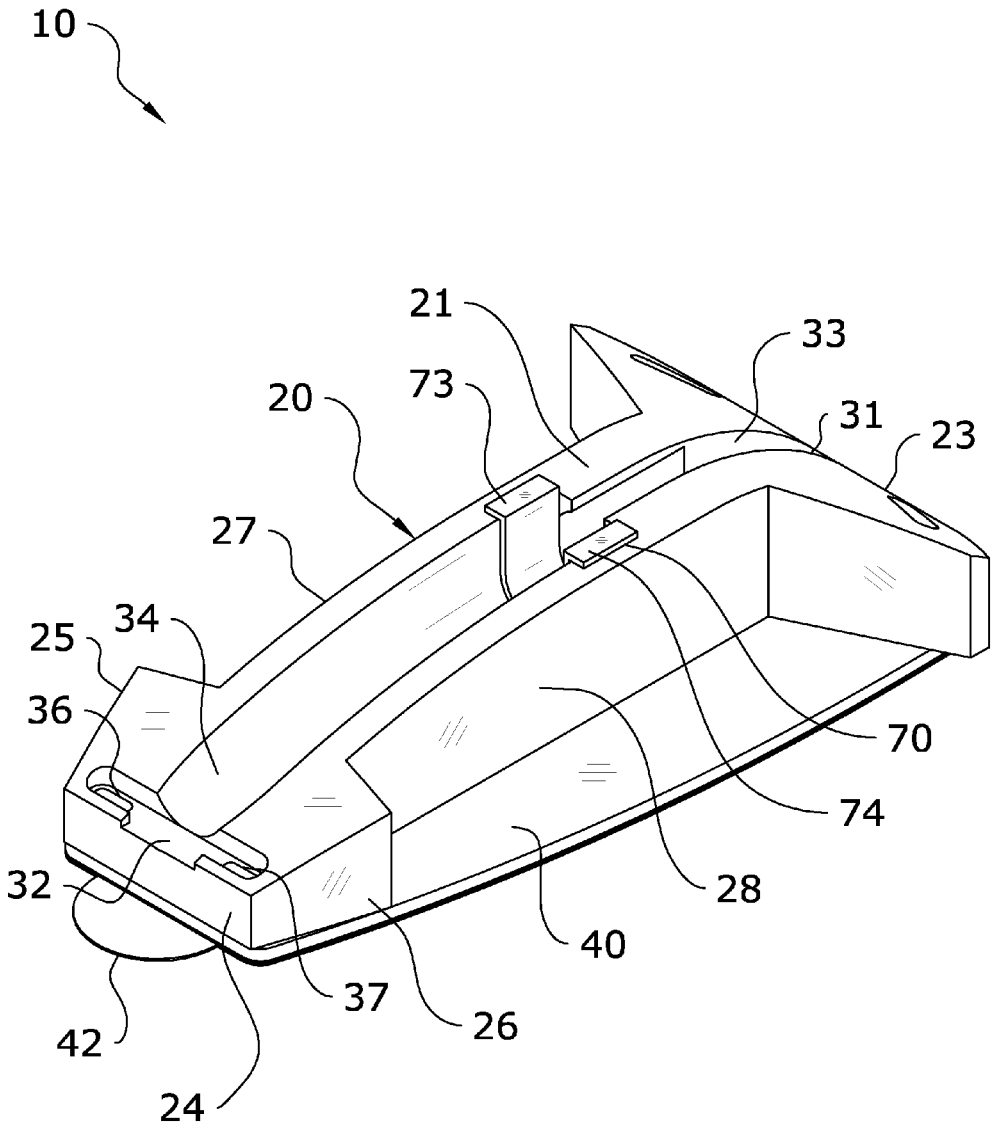
FIG. 6 is an upper perspective view of the housing of the present invention with the adapter installed within the inner channel.
Figure 7:
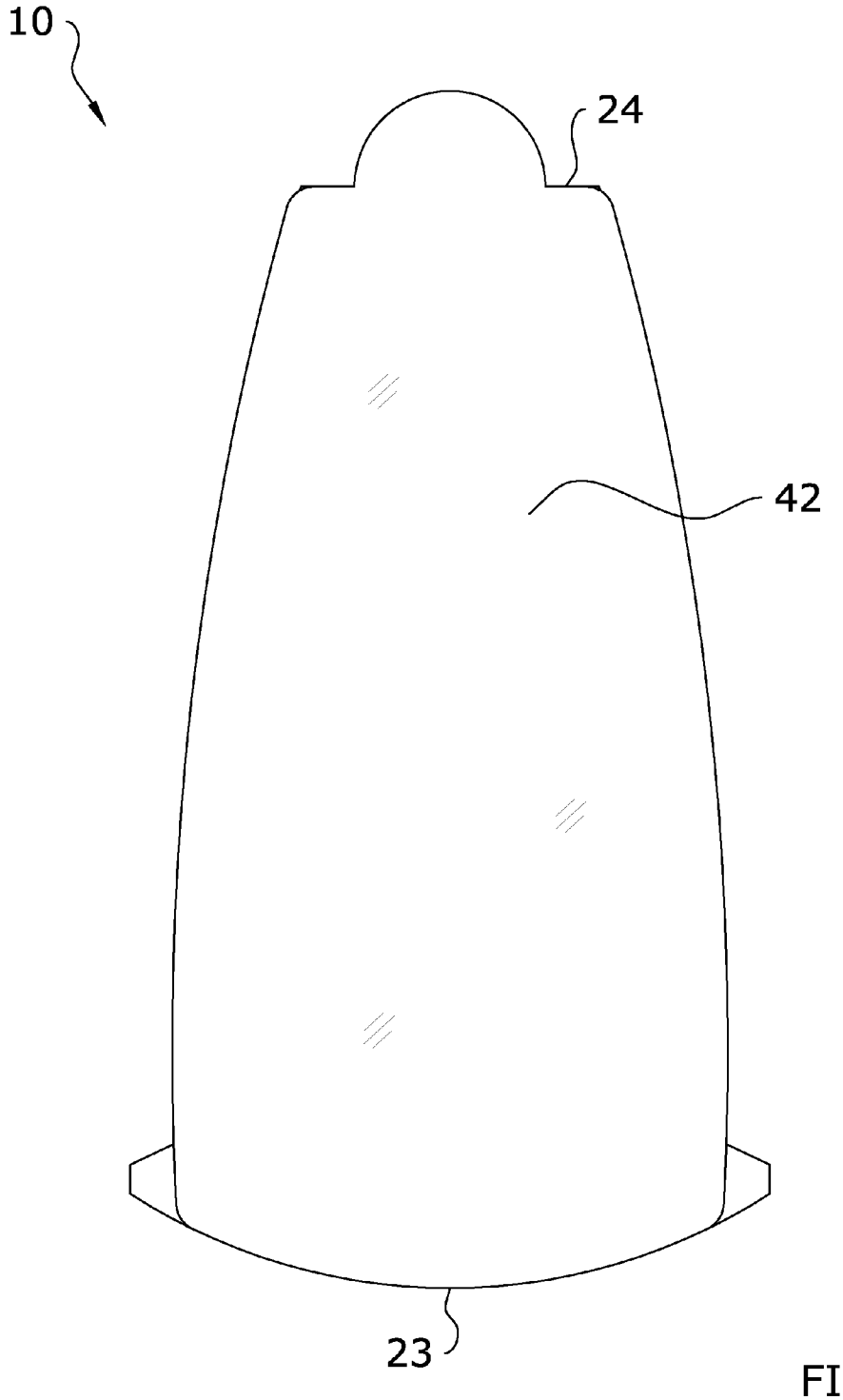
FIG. 7 is a bottom view of the housing of the present invention.

In embodiments using a tube dispenser 60, a separate adapter 70 may be utilized to securely fit the tube dispenser 60 within the inner channel 30 of the housing 20. FIG. 5 best illustrates such an adapter 70. The adapter 70 includes a receiver opening 72 in which the tube dispenser 60 may be positioned, as well as a first flange 73 and a second flange 74 which rest on the upper surface 21 of the housing 20 as shown in FIG. 6. The adapter 70 is thus positioned within the inner channel 30 to reduce its effective width for a more snug fit when installing the tube dispenser 60.

D. Operation of Preferred Embodiment

In use, either the chamber 53 of the syringe dispenser 50 or the pouch 64 of the tube dispenser 60 are filled with a fluid such as breastmilk, milk, or formula. The syringe dispenser 50 or tube dispenser 60 is positioned within the inner channel 30 of the housing 20. An adapter 70 may be utilized to snugly fit the tube dispenser 60 in the inner channel 30 if needed. The flange of the syringe dispenser 50 may be secured within the syringe slots 36, 37 in such embodiments.

Figure 13:
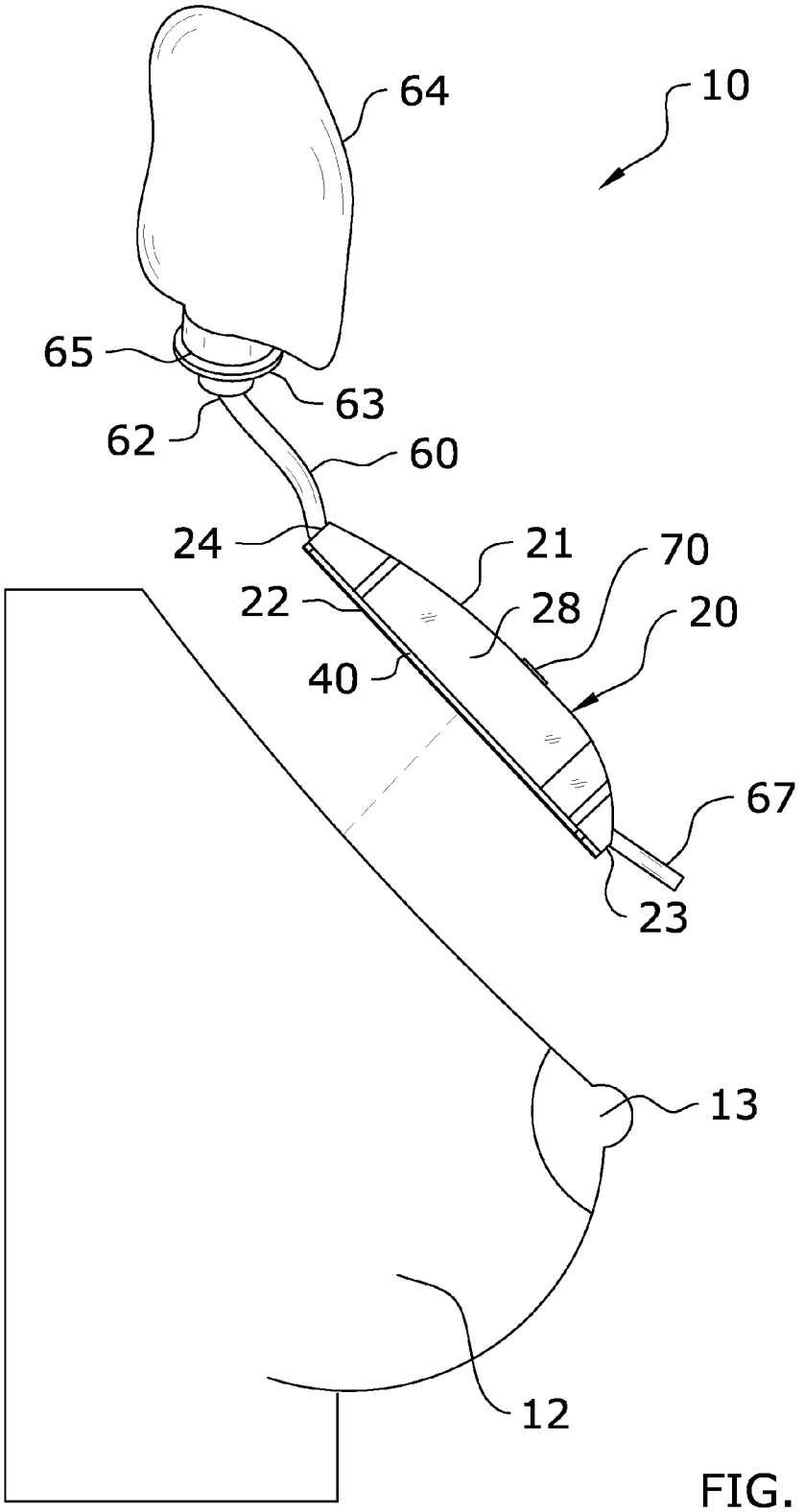
FIG. 13 is a side view of the present invention being installed for use.
Figure 14:
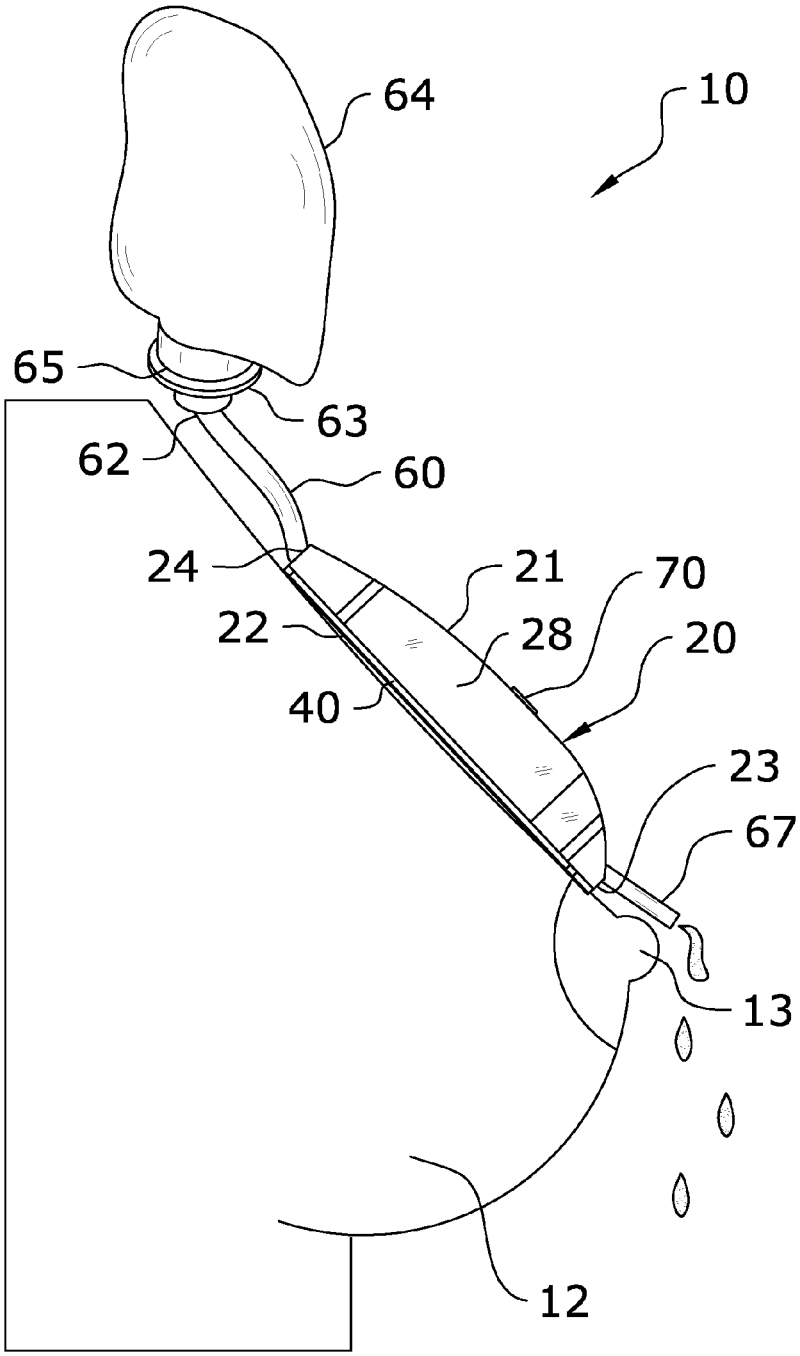
FIG. 14 is a side view of the present invention installed for use.

The housing 20 may be secured to the breast 12 using the securing member 40. FIGS. 13 and 14 illustrate proper positioning of the housing 20, with the tube outlet 57, 67 extending alongside and terminating at a flush position with the nipple 13 of the breast 12. The infant may then be positioned so as to latch onto both the nipple and the outlet 57, 67 of the housing 20.

Thus, an infant may be fed from the housing 20 while still latching onto the breast, simulating breastfeeding for both the mother and infant. To dispense the fluid, the plunger 54 of the syringe dispenser 50 may be activated. For tube dispenser 60 embodiments, the pouch 64 may be constricted to force flow of fluid through the tube dispenser 60. Alternatively, suction or gravity may be utilized to allow fluid flow.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A nursing assistance device, comprising: a housing having a front surface and rear surface and including an inner channel extending along an exterior of said front surface; a securing member for securing said rear surface of said housing to a breast; a dispenser adapted to be positioned within said inner channel; a tube outlet extending out of a front end of said housing, wherein said tube outlet is fluidly connected to said dispenser, wherein said tube outlet includes a distal feeding end that is adapted to be positioned adjacent to a nipple; and a fluid source fluidly connected to said tube outlet.

2. The nursing assistance device of claim 1, wherein said dispenser comprises a syringe dispenser.

3. The nursing assistance device of claim 2, wherein said fluid source comprises a chamber of said syringe dispenser.

4. The nursing assistance device of claim 3, wherein said housing includes one or more syringe slots for receiving a flange of said syringe dispenser.

5. The nursing assistance device of claim 2, wherein said tube outlet is integrally formed with said syringe dispenser.

6. The nursing assistance device of claim 2, wherein said tube outlet is fluidly connected to said syringe dispenser.

7. The nursing assistance device of claim 6, further comprising a coupler for connecting said syringe dispenser with said tube outlet.

8. The nursing assistance device of claim 1, wherein said securing member is comprised of an adhesive.

9. The nursing assistance device of claim 1, wherein said securing member is comprised of a silicone pad.

10. The nursing assistance device of claim 1, further comprising a cover secured over said securing member.

11. The nursing assistance device of claim 1, wherein said dispenser comprises a tube dispenser.

12. The nursing assistance device of claim 11, wherein said tube dispenser comprises an elongated tube.

13. The nursing assistance device of claim 12, wherein said fluid source comprises a pouch fluidly connected with said tube dispenser.

14. The nursing assistance device of claim 13, wherein said pouch is integrally formed with said tube dispenser.

15. The nursing assistance device of claim 13, wherein said pouch is coupled with said tube dispenser.

16. The nursing assistance device of claim 12, wherein said tube outlet is integrally formed with said tube dispenser.

17. The nursing assistance device of claim 12, wherein said tube outlet is fluidly connected to said tube dispenser.

18. The nursing assistance device of claim 12, further comprising an adapter for securing said tube dispenser within said inner channel of said housing.

19. The nursing assistance device of claim 1, wherein said housing includes a first grip depression on its first side and a second grip depression on its second side.

20. The nursing assistance device of claim 1, wherein said inner channel includes a first portion and a second portion, wherein said first portion is narrower than said second portion.

* * * * *